US005683839A

United States Patent [19]

Rider

[11] Patent Number: 5,683,839

[45] Date of Patent: Nov. 4, 1997

[54] METHOD OF PROCESSING BLACK AND WHITE PHOTOGRAPHIC SILVER HALIDE MATERIALS

[75] Inventor: Christopher Barrie Rider, New Malden, United Kingdom

[73] Assignee: Eastman Kodak Company, Rochester, N.Y.

[21] Appl. No.: 641,600

[22] Filed: May 1, 1996

[30] Foreign Application Priority Data

May 4, 1995 [GB] United Kingdom ..... 95090361

[51] Int. Cl.[6] ..... G03C 7/44

[52] U.S. Cl. ..... 430/30; 430/398; 430/400

[58] Field of Search ..... 430/398, 400, 430/30

[56] References Cited

U.S. PATENT DOCUMENTS

| | | | |
|---|---|---|---|
| 4,265,431 | 5/1981 | Falomo | 266/101 |
| 4,995,913 | 2/1991 | Juers | 430/398 |
| 5,294,955 | 3/1994 | Frank | 354/324 |
| 5,480,769 | 1/1996 | Ueflinger et al. | 430/400 |

FOREIGN PATENT DOCUMENTS

| | | |
|---|---|---|
| 0 385 334 B1 | 11/1993 | European Pat. Off. . |
| 0 456 684 B1 | 6/1994 | European Pat. Off. . |

OTHER PUBLICATIONS

Research Disclosure Item No. 36362, Jul. 1994, pp. 397–399, Replenishment and Silver Recovery System for Processing of Silver Halide Photographic Materials.

Research Disclosure Item No. 37252, Apr. 1995, pp. 282–284, Replenishment and Silver Recovery System for Processing of Silver Halide Photographic Materials, Part II.

*Primary Examiner*—Hoa Van Le

*Attorney, Agent, or Firm*—John R. Everett

[57] ABSTRACT

A method of processing a black-and-white photographic silver halide material in which the material is passed though a processing machine having a number of processing tanks including a developing tank, a tank with fixing ability and one or more wash or stabiliser tanks wherein the rate of addition of wash or stabiliser solution to one or more of said wash or stabiliser tanks is a function of the concentration of silver or halide ions in one or more of the wash, stabiliser or fix tanks. No silver recovery means associated with the wash, fix or stabiliser bath is necessary.

17 Claims, 2 Drawing Sheets

METHOD OF PROCESSING BLACK AND WHITE PHOTOGRAPHIC SILVER HALIDE MATERIALS

FIELD OF THE INVENTION

This invention relates to the processing of black-and-white photographic silver halide materials and, in particular, to the management of the washing step.

BACKGROUND OF THE INVENTION

In recent years, there has been an increasing trend to reduce the amount of water used in photographic processing for environmental reasons. Water is recognised as a valuable natural resource and efforts have been made to reduce the amount of water used in washing photographic materials to a minimum. An additional incentive is that in some countries, users of photographic processing apparatus are now charged according to the amount of water used. It can therefore be beneficial to the user to reduce water consumption.

Washing photographic materials is necessary to remove any processing chemicals from the processed material which might, in time, degrade the image. This degradation may happen though destruction of the. image—i.e. a lowering of density—or it may happen through an increase in density as coloured substances are formed within the film or paper. Temperature, humidity and light all have a strong effect in accelerating these processes. To preserve an image adequately, the level of residual chemicals in the processed film must be kept low. In particular, the fixing agent and by-products of the fixing reaction are known to cause image degradation if they are retained in significant amounts in the film.

Stabiliser solutions may also be used instead of water for the wash section of a processor. Stabilisers usually contain additives such as a wetting agent to enhance washing and drying, a biocide to guard against biogrowth in the solution or on tank and roller surfaces, hardening agents and possibly other additives to retard the effects of ageing in the processed photographic material.

In the graphic arts industry, very high contrast black-and-white materials are used. Images are formed with areas of maximum density (black) and minimum density (clear for film and white for paper) only. Traditionally, the major requirement for the washing section of a processor has been to maintain low levels of retained fixing agent (e.g. ammonium thiosulphate) in the processed film. This has been achieved by using very high wash replenishment rates and it has not been uncommon to find graphic arts processors using between 2 and 10 liters of water per square meter of film processed. Retained non-image silver has not usually been a major cause of image deterioration since fixer replenishment rates have also been high. Often, graphic arts processors have been equipped with silver recovery systems which remove silver from the fixing solution and so maintain low silver levels, typically around 2 grams per liter. With such low silver levels in the fixing bath and with large dilutions of silver carried into the wash section made possible by the high wash replenishment rates, the control of retained non-image silver has not been a problem. However, with the use of lower wash solution and fixer replenishment rates, the levels of silver in the wash baths will rise.

European Patent 0,385,334 (Juers) describes a method wherein the minimum wash water replenishment rate in a photographic processor having multiple wash stages depends on the desired residual thiosulphate in the processed film and the concentration of thiosulphate in the fixer.

U.S. Pat. No. 5,294,955 (Frank) describes a method of replenishing washing fluid based on comparing measurements of ionic conductivity of the wash solution in the wash bath with that of the wash replenisher.

U.S. Pat. No. 4,265,431 (Falomo) describes an apparatus in which the flow rate of washing liquid is controlled by means of a sensor in the last wash tank which responds to total salt concentration, the flow being initiated when the total salt concentration exceeds a pre-selected value.

European patent 0,456,684 (Rider) describes a method of controlling the rate of replenishment of chemical solutions used in photographic processing wherein a signal related to the measured exposure given to the photographic material is used to control the replenishment rate.

Soluble complexes of silver with fixing agent are by-products from the fixing reaction. These complexes are produced in the photographic material as the fixing agent reacts with undeveloped silver in the form of silver halide. The complexes diffuse out of the material and into the bulk of the fixing solution. Without silver recovery on the fixing bath, the concentration of complexed silver may build up to quite high levels, especially when low replenishment rates are used for the fixer and when the level of silver in the photosensitive material is high. Since fixing rate shows an inverse dependence on silver concentration in the fixer bath, the time required to clear the film will also depend on the silver level. Whilst silver recovery is therefore beneficial for the performance of the fixer bath, it represents significant extra capital cost.

We have now found that silver recovery is not absolutely necessary in many cases provided precautions are taken to ensure adequate time is allowed for fixing and washing and to ensure that the wash section is able to cope with the demands of removing both the fixing agent (typically ammonium or sodium thiosulphate) as well as the larger soluble silver complexes from the film.

PROBLEM TO BE SOLVED BY THE INVENTION

A particular problem seen upon ageing of processed film for graphic arts is a rise in the optical density in the ultra-violet region of the spectrum of the non-image areas, referred to as "UV $D_{min}$". Frequently, ultra-violet contact exposures are used to copy a graphic arts film onto a printing plate or another piece of film and very high contrast images are needed for accurate copying. If, due to ageing, the difference between the minimum and maximum optical density of the image to be copied is reduced, the contrast of the image is effectively lowered. When the image is copied, inaccuracies may result. Furthermore, if the minimum density of the image increases, the overall exposure time for the copying process increases. For other types of silver halide images, whether black-and-white, such as radiographic images, or colour, such as colour negative, transparencies or prints, changes in the tone scale and contrast of the image upon ageing are also detrimental even if no further copying process is involved because the quality of the image is reduced.

It has been determined experimentally that the action of non-image retained silver is very significantly worse for image degradation, and in particular for $UVD_{min}$ increase, than that of an equal weight of retained fixing agent. Normally, silver complexes are present in the fixer and wash solutions at significantly lower concentrations than the fixing agent. In certain circumstances however, especially in processors without silver recovery, the control of residual silver in the processed film may become more important than the control of residual fixing agent in determining wash water requirements.

Current practice is to use a replenishment rate for the wash such that in worst case conditions the levels of all the residual chemicals in the processed film are acceptable. There is, however, a need to use less wash water during the washing phase in this type of process.

SUMMARY OF THE INVENTION

The present invention provides a method of processing a black-and-white photographic silver halide material in which the material is passed though a processing machine having a number of processing tanks including a developing tank, a tank with fixing ability and one or more wash or stabiliser tanks wherein the rate of addition of wash or stabiliser solution to one or more of said wash or stabiliser tanks is a function of the concentration of silver or halide ions in one or more of the wash, stabiliser or fix tanks.

ADVANTAGEOUS EFFECT OF THE INVENTION

Significant savings in wash water can be achieved without compromising image permanence and without requiring silver recovery.

BRIEF DESCRIPTION OF THE DRAWINGS

FIG. 1 is a schematic diagram of a processing machine which may be used in the present invention while

DETAILED DESCRIPTION OF THE INVENTION

Figure 1:
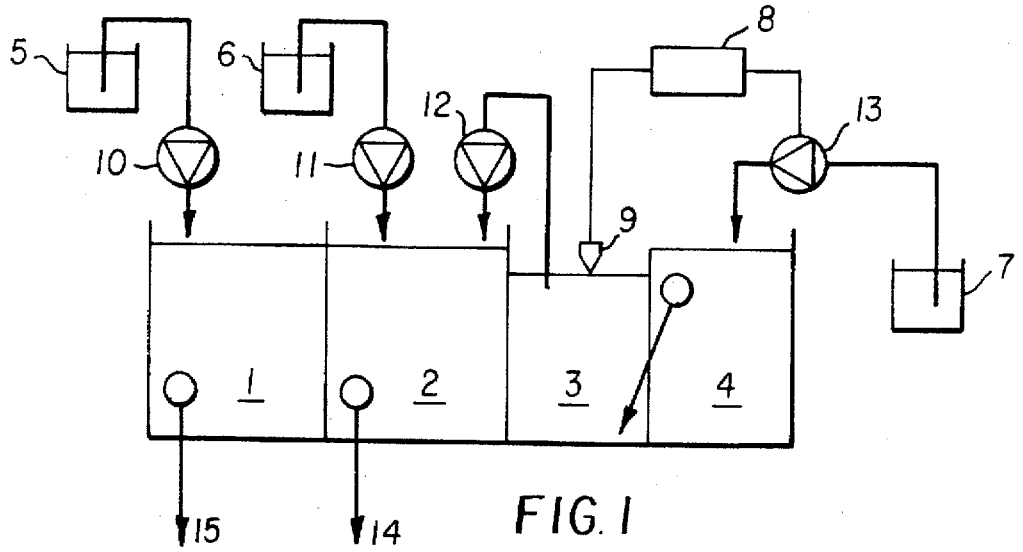

The concentration of the silver or halide may be determined by measurement or calculation. The concentration may itself be proportional to the coated weight of silver in the photographic material being processed. Preferably this amount is determined from data supplied by the manufacturer of the silver halide material which can be in the form of machine- or eye-readable indicia on the material or the packaging associated with the material. The calculation of the silver concentration may also include a term related to the amount of exposure being given to the material being processed.

The function may also be a function of the number of wash and/or stabiliser tanks in the processing machine.

The tank in which the concentration of the silver or halide ions is determined may be the bath with fixing ability nearest the wash or stabiliser tanks or it may be the final bath of the processing machine.

In one embodiment of the present invention the processing machine is not equipped with silver recovery means associated with any wash, fix or stabilise bath.

For the purposes of the following discussion, chemical species whose concentrations in the processing solutions of a replenished process are largely either dependent or independent of average exposure given to the photographic material being processed will be referred to "image-dependent" or "image-independent". The level of silver complexes in the fixer bath will, for example, be image-dependent in a black-and-white process but will be image-independent in a colour process where the image is formed not from silver but from dye. Another example of an image-independent chemical would be the fixer buffering agent. The function of the buffering agent is to maintain pH. In a fixing bath, the buffering agent has to counteract the effects of the developer buffering agent which is carried into the fixer in proportion to the area of photographic material processed.

In a preferred embodiment, the rate of addition of the wash or stabilise solution is above a predetermined minimum value. The minimum should be sufficient to maintain the concentration of one or more image-independent or stain-forming chemical species in any of the wash, stabiliser or fixing baths.

Preferably the amount of silver remaining in the processed material is less than 20 $mg/m^2$ and the amount of thiosulphate remaining is less than 200 $mg/m^2$ of material being processed.

Although control of retained non-image silver may be the prime determinant of wash replenishment rates in some circumstances, residual thiosulphate and other image-independent chemical species are still a significant cause of image degradation upon ageing. The levels of ammonium thiosulphate in a fixer may vary typically between 120 g/l and 180 g/l in a graphic arts processor, depending weakly on the average level of exposure given to the film being processed. This level of variation with average exposure, giving a ratio of 1.5 between the extremes of the range, is much less than for silver, where the ratio in a fixing bath not equipped with silver recovery might be as high as 30 or more and is therefore strongly dependent on exposure. The wash replenishment rate must therefore be set so that the level of residual thiosulphate in the film will always be less than the maximum permitted, as determined from ageing tests.

For example, it is possible define $W_{min}$ for a particular processor and film type as the minimum wash replenishment rate needed to maintain thiosulphate ion and all other image-independent chemicals found in the fixing bath below their maximum acceptable levels in the processed film. This situation would arise when the film had been completely exposed so that all the silver is developed and no silver is therefore removed in the fixing bath.

It will be appreciated that to control the residual levels of image-dependent chemicals in the processed film, the wash replenishment rate must be increased as the levels of these chemicals in the fixer bath increase. Furthermore, it will be appreciated that when the levels of these chemicals in the fixer bath is low, it will be the control of the residual levels of image-independent chemicals that determines the wash replenishment rate. The present invention controls the wash replenishment rate using an algorithm so that levels of all residual chemicals in the processed film always remain below their maximum permitted values. The algorithm relates wash replenishment rate to an image-dependent chemical concentration, such as for example, silver, in either a fixing bath or a wash or stabilise bath. The level of silver in the fixer may be determined either by measurement with a silver sensor or by calculation based either on the exposure given to the film or on a measurement of the integrated density of the processed film.

For each chemical whose residual level must be controlled, there will be a maximum permitted figure for its residual level in the processed film such that when all residual chemicals are at their maximum levels, the processed photographic material will just meet the user's specification for image-stability upon ageing. Once the maximum residual value, $R_i$, for a particular chemical species, i, is known, it is possible to calculate the maximum permitted concentration, $C_{inmax}$, of this chemical species in the last wash bath of a processor with n wash baths through knowledge of the volume of solution, v, carried out with the photographic material from the last wash bath:

$$R_i=C_{inmax}\cdot v.$$

Using standard mass balance equations, it is possible to calculate the concentration of the species i in each wash bath for a given wash replenishment rate into the $n^{th}$ bath assuming the standard counter-current wash replenishment method is being employed. This method assumes that the submersion time of the photographic material in each bath is sufficiently long for the chemical concentrations in the material to have largely equilibrated with the processing solution concentrations. However, efficiency factors to take account of short submersion times may be included if desired. For simplicity the form of the calculation is illustrated for a processor with a single tank wash, where f is the volume of solution carried in from the fixer bath with the film and W is the replenishment rate of the wash solution to give, $$C_{ii}=C_{if}f/(f+W).$$

The concentration of the species in the fixer bath, $C_{if}$, may be measured directly or, for chemicals originally contained within the photographic material, such as silver or halide ions, it may be calculated using the following formula, where F is the fixer replenishment rate, d is the volume of solution carried in with the film from the developer bath and $M_i$ is the mass per unit area of film of the chemical species, i, released from the film in the fixer bath:

$$C_f=M_i/(d+F).$$

For image-dependent chemicals, M is related to the level of exposure given to the film and to the coated weight of the chemical in the unprocessed film. For a high contrast graphic arts material, exposure is usually measured as a percentage of the area which is developed fully. This information may be available from the exposing device directly or it may be obtained by scanning the film optically after development to determine the fractional area of the material which is black. With this information, it is possible to calculate the concentration of the chemical in the fixer bath. Taking the case of silver for example, with a material having a coated weight of 3.5 g/m$^2$ and at an average exposure level of 10%, we would calculate $M_{silver}$ to be 3.15 g/m$^2$. If d and v are both 20 ml/m$^2$, and f is 15 ml/m$^2$, F is 80 ml/m$^2$ and W is 85 ml/m$^2$, we may calculate that, $C_{fix\ silver}$=31.5 g/l, $C_{wash\ silver}$=4.7 g/l and $R_{silver}$=94 mg/m$^2$.

If wash water outflow from the first wash bath, W', is used to dilute fixer concentrate to produce fixer replenisher solution, the form of the calculation would differ slightly so that $$C_{if}=(M_i+W'\cdot C_{i1})/(d+F+W').$$

Using the approach outlined above, provided the concentration in the fixing bath of any chemical which degrades the image upon ageing is known, the minimum wash replenishment to give just adequate washing may be determined. Significant wash savings over the "worst-case" wash replenishment rate may be readily obtained.

It will be evident that the concentrations of image-dependent chemicals in the fixer will be linked. stoichiometrically. Thus, the halide ion molar concentration in the fixer bath will be approximately the same as the silver molar concentration since the ratio of silver to halide ions in a photographic emulsion is 1:1. Any slight differences in molar concentrations in the fixer bath will be due to carry-in of halide from the developer bath and differences in diffusion rates of the species through gelatin, but these differences will be small and may be corrected for. Thus, it is possible to measure the concentrations of just one image-dependent chemical species in the fixer bath and from it calculate the others. This invention has wide applicability across a range of processes where methods of removal of image-dependent chemicals from the fixer bath or any of the wash baths, such as silver recovery, are not used.

As is normal, the processor is preferably controlled by a microprocessor which, by using an appropriate algorithm, can initiate wash water replenishment when needed.

In the accompanying drawings FIG. 1 shows one embodiment of a processing machine which may be used in the present invention. The processor includes a developer tank (1), a fixer tank (2) and two wash tanks (3 & 4). The developer tank (1) is replenished from a holding tank (5) of previously mixed working strength developer replenisher, which is pumped into the developer tank at an appropriate rate by means of pump (10). The fixer tank (2) is replenished by means of pump (11), passing fixer concentrate from the holding vessel (6) and pump (12) passing wash water from wash tank (3) into the fixer tank (2) at an appropriate rate. The rates of replenishment of the solutions supplied by pumps (11) and (12) are maintained in a predetermined ratio. Wash tanks (3) and (4) are arranged such that when fresh wash solution is pumped from holding tank (7) by pump (13) into wash tank (4), the overflow so produced passes into wash tank (3), forming a conventional counter-flow wash section. Level sensor, (9) detects when the level of wash solution in wash tank (3) drops below a certain predetermined level. When the level drops below this predetermined level, a signal produced by the level sensor control means (8) sends a signal to pump (13) to add fresh wash solution to wash tank (4). When the level in wash tank (3) has increased above a certain predetermined level due to the overflow from wash tank (4), the level sensor control means ends the flow of fresh wash solution into wash tank (4). Extra level sensors (not shown) may also be provided so that evaporation losses may be controlled and appropriate extra solution replenishment may be made in any of the tanks.

It is noted that when wash water is used to dilute fixer concentrate to make working strength fixer replenisher (with mixing of the concentrate and wash solution occurring either externally to the fixer bath or internally), fixer considerations, rather than just wash considerations alone, may dictate the exact form of the replenishment control algorithm. For example, one of the functions of a fixer solution is to stop development by having sufficient buffering to drop the internal pH of the photographic material below the lowest pH at which development can be sustained. It may be that for some formulations of fixer solutions, the lowest replenishment rate for the concentrate which enables satisfactory buffering capacity requires a replenishment rate for the wash at a higher level than what would be strictly necessary to control residual chemicals below their maximum levels.

The simplest functional dependence between silver or halide ion concentration and replenishment rate is a linear one with $W_{min}$ defining the minimum in the case when there are no image-dependent chemicals in the fixer bath. Preferably silver concentration will be used, though it will be understood that image-dependent chemicals are formed in proportion to one another. It will be appreciated that many other relationships between wash replenishment rate and the chosen image-dependent chemical concentration are possible according to the need of each processor configuration.

Figure 2:
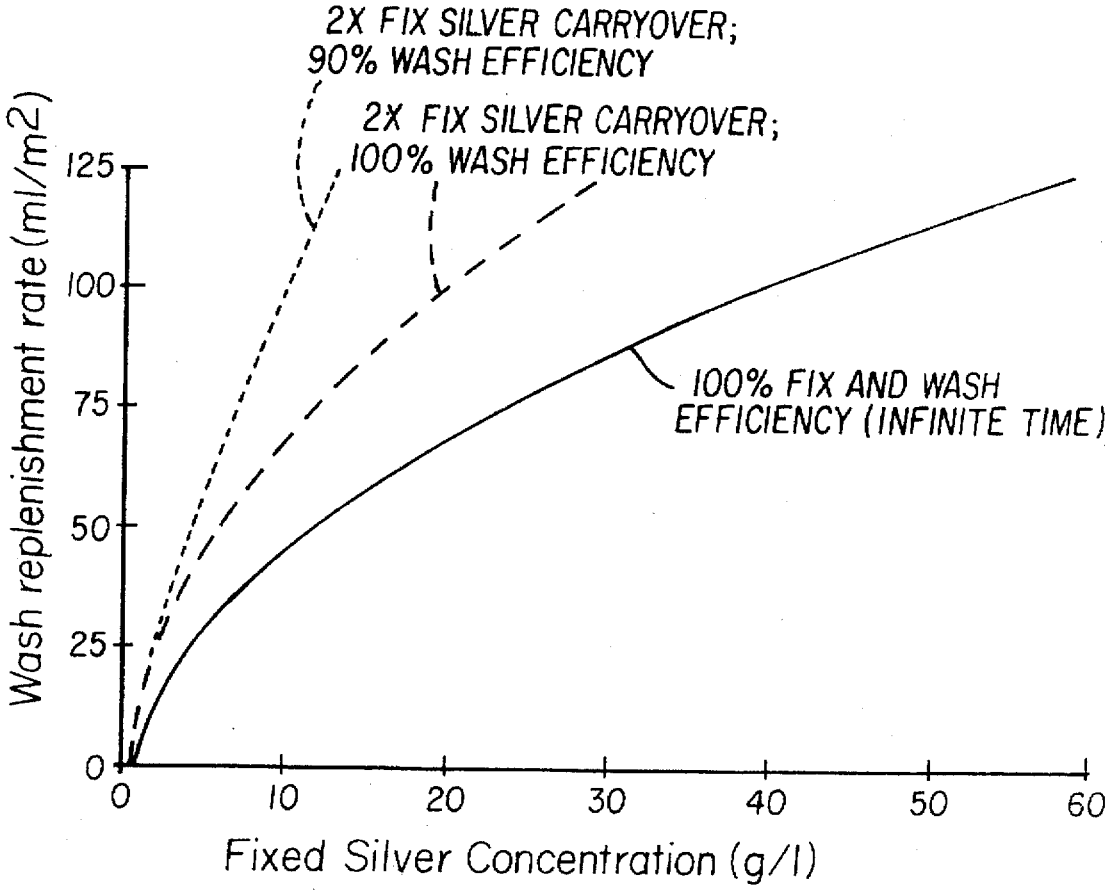
FIGS. 2 and 3 are plots of wash replenishment rates versus fixer silver concentration.

To control the residual silver alone, it can easily be shown by mass balance considerations for the example above that the wash replenishment rate has a strong quadratic (i.e. a polynomial of order two) dependence on exposure as shown in FIG. 2. The squared term arises from the number of wash tanks involved. For comparison, 3 curves have been calculated, all of which maintain a level of residual silver in the processed film of 20 mg/m$^2$. The continuous line shows the relation between wash replenishment rate and fixer silver concentration when fix and wash times are effectively infinite. A wash replenishment rate of only 100 ml/m$^2$ is theoretically enough to wash the film with a fixer silver concentration of around 40 g/l. The dashed and dotted curves show the effect of a short fix times where silver in the film does not have sufficient time to equilibrate with the fixing solution, resulting in double the carryover of silver compared with the theoretical minimum. The dotted curve also includes the calculated effect of a short wash time where only 90% of the silver carried into each wash bath in or on the film has time to be washed out. In that case, a wash replenishment rate of 100 ml/m$^2$ will only control silver adequately from a fixer bath with 10 g/l silver concentration.

Figure 3:
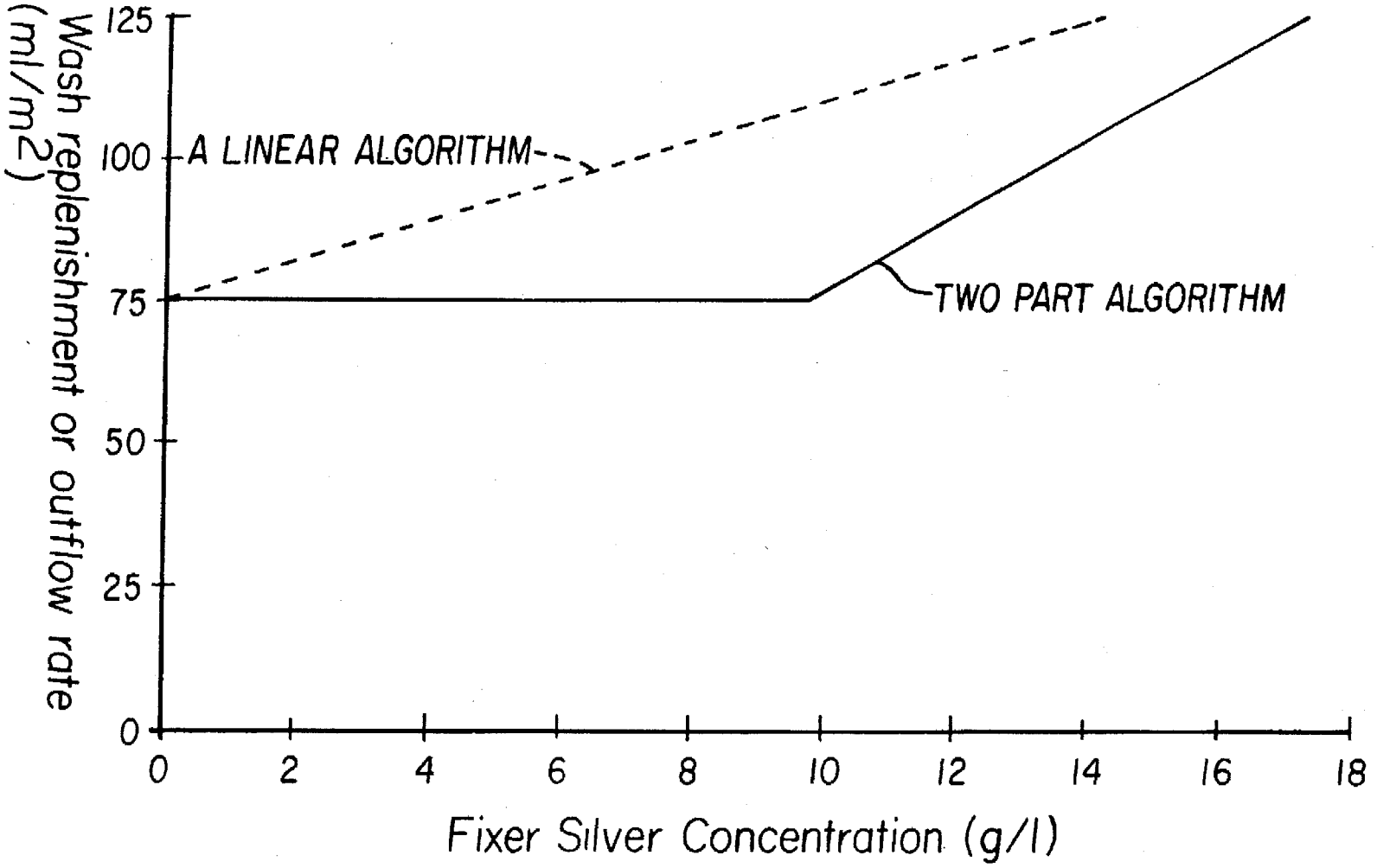

The curves shown in FIG. 2 would not be suitable as a wash algorithm since they do not attempt to control image-independent chemicals. For the example above, it was found that a minimum wash replenishment rate of 75 ml/m$^2$ was necessary. Setting $W_{min}$ at 75 ml/m$^2$, therefore, we may expect a two-part algorithm to be useful: one part following the quadratic relationship for wash replenishment rates greater than $W_{min}$ and fixer silver concentrations greater than a threshold value, $C_{threshold}$, and a second part with constant wash replenishment rate for fixer silver concentrations below $C_{threshold}$. This type of algorithm is shown in FIG. 3 where the carryover of silver from the fixer bath into the wash bath was taken to be 1.5 times the theoretical minimum and where the wash efficiency was 90%. For comparison, an example of a simple one part linear algorithm is shown on the same plot. The two part algorithm shown would be suitable for controlling the processor and film described in the example above. The quadratic dependency is not strongly evident in the algorithm. Clearly, for simplicity of programming the algorithm into a microprocessor, the curved part could be replaced with a straight line with little or no loss of effectiveness.

It will be evident that since the exact functional dependence of the first part of the algorithm depends on the number of wash baths, the value of $C_{threshold}$ will also vary with the number of wash baths as well as with the processing time in both fixer and wash baths. Given that $W_{min}$ is 75 ml/m$^2$, in FIG. 2 $C_{threshold}$ would take values of 23 g/l, 12 g/l and 7.5 g/l for the continuous, dashed and dotted lines respectively.

In general $W_{min}$ may be determined by ageing tests or it may be specified by stain considerations. For example, coloured substances from the developer bath, such as sensitising dyes and development reaction by-products, are passed into the fixing bath in the swollen photographic material being processed. These are diluted somewhat in the fixer and still further in the wash section. In systems where stain is a problem, $W_{min}$ may need to be set relatively high to control residual levels of stain forming chemicals.

In case of stain control, the wash algorithm could be usefully combined with sensors to determine the level of stain forming compounds in any of the wash or fixing baths. For example, an optical sensor measuring the transmittance of the solution would generate data relating to the concentration of stain-forming chemicals in any of the wash or fixing baths. This data could be used for determining $W_{min}$ which may vary according to the type of film products being processed.

Further information of use in determining $W_{min}$ is the electrical conductivity of the wash solution in the wash baths. This signal is related to the level of ions in the water and primarily to the level of the fixing agent, such as thiosulphate ion, which is present in significantly greater quantity than any other ionic species. In an advanced wash replenishment control system, it would be possible to use a conductivity sensor to vary $W_{min}$ from an initial low position where all the wash solutions are fresh to a higher value as the solutions become more seasoned. Stain control sensors could also perform this function if stain is a more significant determinant of $W_{min}$ than residual thiosulphate ion.

Algorithms to control wash replenishment may therefore take a whole variety of different forms to suit the particular film and solutions being used and will also depend on the processor configuration.

It will further be appreciated that if a sensor is used to determine the concentration of the silver or halide ions used in the wash replenishment algorithm, it may be placed either in the fixer bath or in any of the wash baths. This is possible, because, using the methods of calculation outlined above, the concentration of the silver or halide ions may be calculated for all the fixer and wash baths providing it is known for one of them.

Yet further sophistication may be introduced into the control of wash replenishment solution by performing real-time calculation of the concentration of silver or halide ions in the fixer and wash baths. This feature maintains aminimum use of wash solution during seasoning of the processor from a start-up condition. When wash and fix solutions are fresh, with low levels of silver or halide ions, replenishment rates may be deliberately kept low until the concentration of these chemicals builds up to the point where control of residual levels of the chemicals in the processed film demands that the correct replenishment rates, according to the normal algorithm, be used. This technique may not be applicable, however, if wash and fix replenishment rates are linked.

The highest level of sophistication and reliability is gained by measuring the concentration of the key species in the final wash bath before the dryer section. Whilst it is known to measure general properties such as conductivity, which register ion-concentration, it is not known to use a silver sensor in the final wash bath to measure silver and other image-dependent species. In this way very accurate control of residual levels of silver and other image-dependent species may be obtained. In a start-up situation, the sensor will automatically show a low level of silver and will cause the replenishment control system to adopt minimum replenishment rates. As the wash solution silver levels rise, wash solution replenishment may be adjusted to maintain a constant level of residual silver in the processed film. This method provides for the most efficient use of wash solution. Again this may not be applicable, however, if wash and fix replenishment rates are linked.

The preceding description of wash replenishment rate algorithms does not deal with the replacement of wash solution lost through evaporation from the processing baths. It is normal practice to use level sensors on the wash baths to perform this function so that when the processor is switched on after a long period without use, the level sensors will register a loss of solution and will cause wash solution to be replenished automatically. If so desired the evaporation rates may be determined and automatic replenishment built into the wash replenishment control algorithm so that in addition to the algorithm described above, a time-dependent component may be implemented whereby an extra amount of wash solution may be added to the wash baths to replace evaporation losses.

The replacement of evaporation losses in the fixer tank has an important impact on washing in that if the losses are not replaced with water, silver concentrations in the fixer tank increase with time and this will cause an extra build-up of silver in the wash tanks due to carryover. In the case where the outflow from the wash tank nearest the fixer tank is used to replace evaporation losses in the fixer tank, this will require an effective increase in wash replenishment rates to maintain wash tank level.

A preferred method of achieving compensation for evaporation losses in both fixer and wash tanks in a processor where wash outflow is added to the fixer bath is to vary the ratio, ρ, between the volume of wash outflow and fixer replenisher added to the fixer tank as a function of time. Additionally, wash tank level is controlled by a level sensor in the wash tank nearest the fixer tank which controls the addition of wash replenisher into the wash tank furthest from the fixer tank. Overflow from this tank replenishes the next wash tank and so on in a countercurrent arrangement until the level rises in the wash tank. nearest the fixer tank and causes a level sensor transition.

When there are significant periods of activity, it is preferred to alter the ratio, ρ, from 2:1 up to 4:1 as the elapsed time since the last piece of film was processed increases. A particularly preferred method of doing this is to have different values of ρ for different bands of elapsed time. Such bands may run from under 600 seconds to greater than 2400 seconds with the value of ρ changing in steps of 0.5.

The silver concentration in the seasoned fixer of such a graphic arts processor may vary typically from as little as 1 g/l to as much as 30 g/l depending on the silver content of the photographic material being processed, the average exposure given to it and the fixer replenishment rate. Since residual silver in the processed material is a very significant cause of image degradation after processing it must be kept below a threshold level. This threshold level is set by knowing the maximum changes in the image characteristics which would remain acceptable to users and then determining, by means of keeping tests, what level of residual chemicals will produce these maximum changes. For example, many users require that the minimum UV density of the film should not increase above 0.1. It has been determined using ANSI Standard simulated 10 year keeping tests that if residual silver is kept below 20 mg/m$^2$ and the residual thiosulphate is kept below 200 mg/m$^2$, the UV $D_{min}$ will not exceed 0.1 after 10 years of ageing. For a typical graphic arts imagesetting film and processor, the level of silver in the final wash tank would need to be kept below 1 g/l to keep the residual silver in the processed film below 20 mg/m$^2$.

The following Examples are included for a better understanding of the invention.

EXAMPLE 1

This example relates to the processing of graphic arts imagesetting films for laser exposure in the processor illustrated in FIG. 1 with no silver recovery means.

The films are processed in the following sequence:

| | |
|---|---|
| Develop | 24s @ 35° C. |
| Fix | 24s @ 35° C. |
| Wash | 28s total at 23° C. |

The wash was carried out in two tanks the last of which is replenished with water with the overflow flowing into the first tank.

The developer was Kodak RA2000 developer diluted 1:2 parts water, the fixer was as follows:

| | |
|---|---|
| Acetic Acid | 30 g/l |
| Ammonium Acetate | 68 g/l |
| Ammonium Thiosulphate | 500 g/l |
| Ammonium Sulphite | 40 g/l |
| Water - demineralised to | 1 litre. |

The wash baths were filled with water from the public supply.

In this example, fixer and wash replenishment rates are linked because outflow from the wash bath nearest the fixer bath is used in total to dilute fixer concentrate in the fixer bath. The algorithm chosen maintains a constant ratio of 2:1 between wash outflow and fixer replenishment rate. Under these circumstances the wash replenishment rate is usually slightly greater than the wash outflow rate because of evaporation losses. For fixer silver concentrations below around 9.5 g/l, the wash outflow rate and fix concentrate replenishment rate are kept constant at 75 concentrations above 9.5 g/l, the wash replenishment rate increases linearly with silver concentration such that at 17 g/l the wash outflow rate is 125 ml/m$^2$.

The algorithm was chosen for simplicity of implementation by the processor control system. Further refinements are possible.

The processor was seasoned by processing several hundred square meters of a high contrast graphic arts imagesetting film with a coated silver weight of 3.3 g/m$^2$ under the following conditions:

Case A: The film received 2% exposure by area. Wash outflow rate 125 ml/m$^2$.

Case B: The film received 80% exposure by area. Wash outflow rate 75 ml/m$^2$.

When the processor was substantially seasoned in each case measurements of silver and thiosulphate ion concentration were made.

| Case | Film exposure (%) | Fixer Ag conc. (g/l) | Fixer thiosulphate ion conc. (g/l) | Film Residual Ag (mg/m$^2$) | Film Residual thiosulphate ion (mg/m$^2$) |
|---|---|---|---|---|---|
| A | 2 | 18.5 | 136 | 8 | 22 |
| B | 80 | 7.1 | 122 | 5 | 40 |

Case A presents a "worst case" situation for washing. A wash replenishment rate of 125 ml/m$^2$ is sufficient to control the residual silver and thiosulphate ion concentrations below their targets of 20 mg/m$^2$ and 200 mg/m$^2$ respectively.

Case B presents a much lighter load to the washing section of the processor and a reduced wash replenishment rate is able to control both residual chemicals below their targets. Case B therefore represents considerable savings in wash water consumption over the prior art where wash replenishment rates are held at a constant value sufficient to handle the worst case situation represented by Case A.

EXAMPLE 2

Changes in silver concentration in the fixer and wash tanks of the processor used in Example 1 were investigated. In particular, the effect of varying the dilution ratio, ρ, of the fixer replenisher by wash outflow added to the fixer tank, as a function of elapsed time since the last sheet of film passed through the processor was studied.

The film silver coated weight was 3.3 gm/m$^2$, the area of a roll of film is 45 m$^2$, a sheet of film has an area of 0.42 m$^2$ and the sheets are processed at equal intervals throughout a 12 hour day. The fixer replenisher rate was 67.5 ml/m$^2$ for a 10% exposed film (by area), and 50 ml/m$^2$ for a 50% exposed film with a normal dilution ratio of fixer to wash of 2. The evaporation level from the fixer tank was 30 ml/hour when processing and 15 ml/hour when the tanks had cooled down.

Two cases were studied: the first, Case C, for a constant dilution ratio of 2 and a second, Case D, where the dilution ratio was varied according to the elapsed the since the last'sheet was processed, τ, in the following manner:

| | | | | | | |
|---|---|---|---|---|---|---|
| If | | τ | < | 600s | then | ρ = 2 |
| If | 600s ≦ | τ | < | 1800s | then | ρ = 2.5 |
| If | 1800s ≦ | τ | < | 3600s | then | ρ = 3 |
| If | | τ | > | 3600s | then | ρ = 3.5 |

Results show the seasoned silver concentrations in the fixer tank as the amount of film processed per week is varied for 10% and 50% exposure levels. As a guide, it was desired to maintain the silver concentration below 20 g/l in the fixer tank.

| | Fixer Silver Concentration (g/l) | | | |
|---|---|---|---|---|
| Rolls/ | 10% exposure | | 50% exposure | |
| Week | Case C | Case D | Case C | Case D |
| 1.0 | 30.6 | 19.0 | 24.3 | 14.0 |
| 1.5 | 23.7 | 19.0 | 17.2 | 13.5 |
| 2.0 | 21.4 | 17.6 | 15.0 | 12.2 |

The results show that case D is successful in maintaining a fixer silver concentration below 20 g/l even under low throughput conditions where evaporation is more of a problem.

I claim:

1. A method of processing a black-and-white photographic silver halide material in which the material is passed though a processing machine having a number of processing tanks including a developing tank, a tank with fixing ability and one or more wash or stabiliser tanks wherein the rate of addition of wash or stabiliser solution to one or more of said wash or stabiliser tanks is a function of the concentration of silver or halide ions in one or more of the wash, stabiliser or fix tanks.

2. A method as claimed in claim 1 in which the processing machine is not equipped with silver recovery means associated with any wash, fix or stabiliser bath.

3. A method as claimed in claim 1 or 2 in which the rate of addition of the wash or stabiliser solution to any tank is above a predetermined minimum. value.

4. A method as claimed in any in which the function is such that the fully processed material contains less than 200 mg/m$^2$ of thiosulphate ion and 20 mg/m$^2$ of non-image silver.

5. A method as claimed in claim 3 in which the concentration of the silver or halide ions is determined by measurement.

6. A method as claimed in claim 3 in which the concentration of the silver or halide ions is determined by calculation using a term including the coated weight of silver in the photographic material being processed.

7. A method as claimed in claim 6 in which the coated weight of silver is determined from data supplied by the manufacturer of the silver halide material.

8. A method as claimed in claim 7 wherein the data is represented by machine- or eye-readable indicia on the material or the packaging associated with the material.

9. A method as claimed in claim 7 in which the calculation also uses a term including the amount of exposure being given to the material being processed.

10. A method as claimed in claim 7 in which said function is also a function of the number of wash and/or stabiliser tanks and/or a function of the fixing time and/or washing time and/or stabilising time.

11. A method as claimed in claim 7 in which the tank in which the concentration of the silver or halide ions is determined is the bath with fixing ability nearest the wash or stabiliser tanks.

12. A method as claimed in claim 7 in which the tank in which the concentration of the silver or halide ions is determined is the final bath of the processing machine.

13. A method as claimed in claim 12 in which the outflow from the wash or stabiliser tank nearest the fixer tank(s) is linked to the rate of addition of fixer replenisher solution in a predetermined ratio.

14. A method as claim 13 in which the ratio of the outflow from the wash or stabiliser tank nearest the fixer tank(s) to the rate of addition of fixer replenisher solution is increased as the elapsed time since the last piece of photographic material was processed.

15. A method as claimed in claim 14 in which the minimum value is determined based on a measurement of the concentration of one or more image-independent or stain-forming chemical species in any of the wash, stabiliser or fixing baths.

16. A method as claimed in claim 15 in which the function comprises an additional time-dependent component to replace evaporation losses from any of the wash, fix or stabiliser tanks.

17. A method as claimed in claim 16 in which the photographic silver halide material is a high contrast graphic arts material.

* * * * *